US009426866B2

(12) United States Patent
Melanson et al.

(10) Patent No.: US 9,426,866 B2
(45) **Date of Patent: *Aug. 23, 2016**

(54) LIGHTING SYSTEM WITH LIGHTING DIMMER OUTPUT MAPPING

(71) Applicant: KONINKLIJKE PHILIPS N.V., Eindhoven (NL)

(72) Inventors: John L. Melanson, Austin, TX (US); John J. Paulos, Austin, TX (US)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

This patent is subject to a terminal disclaimer.

(21) Appl. No.: 14/676,449

(22) Filed: Apr. 1, 2015

(65) Prior Publication Data

US 2015/0208484 A1 Jul. 23, 2015

Related U.S. Application Data

(60) Continuation of application No. 14/010,087, filed on Aug. 26, 2013, now Pat. No. 9,000,680, which is a (Continued)

(51) Int. Cl.
*H05B 37/02* (2006.01)
*H05B 33/08* (2006.01)

(52) U.S. Cl.
CPC ..... *H05B 37/0209* (2013.01); *H05B 33/0809* (2013.01); *H05B 33/0848* (2013.01); *H05B 37/02* (2013.01)

(58) Field of Classification Search
CPC .... H05B 37/02; H05B 37/0209; H05B 33/08; H05B 33/0809; H05B 33/0833; H05B 33/0848
USPC ..... 315/200 R, 246, 247, 291, 307, DIG. 4
See application file for complete search history.

(56) References Cited

U.S. PATENT DOCUMENTS 5,179,324 A 1/1993 Audbert
5,604,411 A 2/1997 Venkitasubrahmanian et al.

(Continued)

FOREIGN PATENT DOCUMENTS

CN 101164383 A 4/2008
CN 101505568 A 8/2009

OTHER PUBLICATIONS

Response to Amendment under 37 CFR 1.312 dated Mar. 4, 2015, mailed in U.S. Appl. No. 14/010,087, pp. 1-2.

(Continued)

*Primary Examiner* — Jimmy Vu

(57) ABSTRACT

A system and method map dimming levels of a lighting dimmer to light source control signals using a predetermined lighting output function. The dimmer generates a dimmer output signal value. At any particular period of time, the dimmer output signal value represents one of multiple dimming levels. In at least one embodiment, the lighting output function maps the dimmer output signal value to a dimming value different than the dimming level represented by the dimmer output signal value. The lighting output function converts a dimmer output signal values corresponding to measured light levels to perception based light levels. A light source driver operates a light source in accordance with the predetermined lighting output function. The system and method can include a filter to modify at least a set of the dimmer output signal values prior to mapping the dimmer output signal values to a new dimming level.

20 Claims, 10 Drawing Sheets

Related U.S. Application Data continuation of application No. 12/474,714, filed on May 29, 2009, now Pat. No. 8,536,794, which is a division of application No. 11/695,024, filed on Apr. 1, 2007, now Pat. No. 7,667,408.

(60) Provisional application No. 60/894,295, filed on Mar. 12, 2007.

(56) References Cited

U.S. PATENT DOCUMENTS

| | | | | |
|---|---|---|---|---|
| 5,629,607 | A | 5/1997 | Callahan et al. | |
| 5,661,645 | A | 8/1997 | Hochstein | |
| 6,714,425 | B2 | 3/2004 | Yamada et al. | |
| 7,339,329 | B2 | 3/2008 | Makimura et al. | |
| 7,667,408 | B2 * | 2/2010 | Melanson et al. | 315/209 R |
| 7,750,580 | B2 | 7/2010 | Lu et al. | |
| 7,982,415 | B2 | 7/2011 | Kimura | |
| 8,487,546 | B2 | 7/2013 | Melanson | |
| 8,536,799 | B1 | 9/2013 | Grisamore et al. | |
| 8,547,034 | B2 | 10/2013 | Melanson et al. | |
| 8,581,518 | B2 | 11/2013 | Kuang et al. | |
| 8,610,364 | B2 | 12/2013 | Melanson et al. | |
| 8,610,365 | B2 | 12/2013 | King et al. | |
| 8,664,885 | B2 | 3/2014 | Koolen et al. | |
| 8,716,957 | B2 | 5/2014 | Melanson et al. | |
| 8,847,515 | B2 | 9/2014 | King et al. | |
| 9,000,680 | B2 * | 4/2015 | Melanson et al. | 315/291 |
| 2008/0203934 | A1 | 8/2008 | Van Meurs | |
| 2011/0316441 | A1 | 12/2011 | Huynh | |
| 2012/0112651 | A1 | 5/2012 | King et al. | |
| 2013/0193879 | A1 | 8/2013 | Sadwick et al. | |

OTHER PUBLICATIONS

Response to Notice to File Corrected Application Papers and Amendment under 37 CFR 1.312 as filed in U.S. Appl. No. 14/010,087 on Feb. 26, 2015, pp. 1-4.

Notice of Allowance dated Nov. 26, 2014, mailed in U.S. Appl. No. 14/010,087, pp. 1-19.

Terminal Disclaimer as filed in U.S. Appl. No. 14/010,087 on Nov. 5, 2014, pp. 1-2.

Terminal Discalimer Approval dated Nov. 5, 2014, mailed in U.S. Appl. No. 14/010,087, 1 page.

Response to Final Office Action dated Aug. 1, 2014, as filed in U.S. Appl. No. 14/010,087 on Nov. 5, 2014, pp. 1-16.

Final Office Action dated Aug. 1, 2014, mailed in U.S. Appl. No. 14/010,087, pp. 1-21.

Response to Non-Final Office Action dated Dec. 6, 2013, as filed in U.S. Appl. No. 14/010,087 on Apr. 7, 2014, pp. 1-16.

Non-Final Office Action dated Dec. 6, 2013, mailed in U.S. Appl. No. 14/010,087, pp. 1-17.

Supertex, Inc., HV9931 Unity Power Factor LED Lamp Driver, pp. 1-7, 2005, Sunnyvale, CA, USA. (Per MPEP 609.04(a), Applicant points out that the year of publication is sufficiently earlier than the effective U.S. filing date and any foreign priority date so that the particular month of publication is not in issue).

Wang Xiao, Phase Control Dimming of the Dimmable Lighting System, Journal of Wuxi University of Light Industry, Jul. 31, 2000, vol. 19, No. 4, pp. 1-3. The Abstract contains a concise explanation in English, and the Search Report identifies the following portions as related to the claims in the Present Application: p. 408, right-hand column, section 2, and figures 5-7.

* cited by examiner

LIGHTING SYSTEM WITH LIGHTING DIMMER OUTPUT MAPPING

CROSS-REFERENCE TO RELATED APPLICATION

This application claims the benefit under 35 U.S.C. §119(e) and 37 C.F.R. §1.78 of U.S. Provisional Application No. 60/894,295, filed Mar. 12, 2007 and entitled "Lighting Fixture". U.S. Provisional Application No. 60/894,295 includes exemplary systems and methods and is incorporated by reference in its entirety.

U.S. Provisional Application No. 60/909,458 entitled "Ballast for Light Emitting Diode Light Sources", inventor John L. Melanson, and filed on Apr. 1, 2007 describes exemplary methods and systems and is incorporated by reference in its entirety.

U.S. patent application Ser. No. 11/695,023 entitled "Color Variations in a Dimmable Lighting Device with Stable Color Temperature Light Sources", inventor John L. Melanson, and filed on Apr. 1, 2007 describes exemplary methods and systems and is incorporated by reference in its entirety.

U.S. Provisional Application No. 60/909,457 entitled "Multi-Function Duty Cycle Modifier", inventors John L. Melanson and John Paulos, and filed on Apr. 1, 2007 describes exemplary methods and systems and is incorporated by reference in its entirety.

BACKGROUND OF THE INVENTION

1. Field of the Invention

The present invention relates in general to the field of electronics, and more specifically to a system and method for mapping an output of a lighting dimmer in a lighting system to predetermined lighting output functions.

2. Description of the Related Art

Commercially practical incandescent light bulbs have been available for over 100 years. However, other light sources show promise as commercially viable alternatives to the incandescent light bulb. Gas discharge light sources, such as fluorescent, mercury vapor, low pressure sodium, and high pressure sodium lights and electroluminescent light sources, such as a light emitting diode (LED), represent two categories of light source alternatives to incandescent lights. LEDs are becoming particularly attractive as main stream light sources in part because of energy savings through high efficiency light output and environmental incentives such as the reduction of mercury.

Incandescent lights generate light by passing current through a filament located within a vacuum chamber. The current causes the filament to heat and produce light. The filament produces more heat as more current passes through the filament. For a clear vacuum chamber, the temperature of the filament determines the color of the light. A lower temperature results in yellowish tinted light and a high temperature results in a bluer, whiter light.

Gas discharge lamps include a housing that encloses gas. The housing is terminated by two electrodes. The electrodes are charged to create a voltage difference between the electrodes. The charged electrodes heat and cause the enclosed gas to ionize. The ionized gas produces light. Fluorescent lights contain mercury vapor that produces ultraviolet light. The housing interior of the fluorescent lights include a phosphor coating to convert the ultraviolet light into visible light.

LEDs are semiconductor devices and are driven by direct current. The lumen output intensity (i.e. brightness) of the LED varies approximately in direct proportion to the current flowing through the LED. Thus, increasing current supplied to an LED increases the intensity of the LED, and decreasing current supplied to the LED dims the LED. Current can be modified by either directly reducing the direct current level to the white LEDs or by reducing the average current through pulse width modulation.

Dimming a light source saves energy when operating a light source and also allows a user to adjust the intensity of the light source to a desired level. Many facilities, such as homes and buildings, include light source dimming circuits (referred to herein as a "dimmer").

FIG. 1A depicts a lighting circuit 100 with a conventional dimmer 102 for dimming incandescent light source 104 in response to inputs to variable resistor 106. The dimmer 102, light source 104, and voltage source 108 are connected in series. Voltage source 108 supplies alternating current at line voltage $V_{line}$. The line voltage $V_{line}$ can vary depending upon geographic location. The line voltage $V_{line}$ is typically 110-120 Vac or 220-240 Vac with a typical frequency of 60 Hz or 70 Hz. Instead of diverting energy from the light source 104 into a resistor, dimmer 102 switches the light source 104 off and on many times every second to reduce the total amount of energy provided to light source 104. A user can select the resistance of variable resistor 106 and, thus, adjust the charge time of capacitor 110. A second, fixed resistor 112 provides a minimum resistance when the variable resistor 106 is set to 0 ohms. When capacitor 110 charges to a voltage greater than a trigger voltage of diac 114, the diac 114 conducts and the gate of triac 116 charges. The resulting voltage at the gate of triac 116 and across bias resistor 118 causes the triac 116 to conduct. When the current I passes through zero, the triac 116 becomes nonconductive, (i.e. turns 'off'). When the triac 116 is nonconductive, dimmer output voltage $V_{DIM}$ is 0 V. When triac 116 conducts, the dimmer output voltage $V_{DIM}$ equals the line voltage $V_{line}$. The charge time of capacitor 110 required to charge capacitor 110 to a voltage sufficient to trigger diac 114 depends upon the value of current I. The value of current I depends upon the resistance of variable resistor 106 and resistor 112.

In at least one embodiment, the duty cycles, and, correspondingly, the phase angle, of dimmer output voltage $V_{DIM}$ represent dimming levels of dimmer 102. The limitations upon conventional dimmer 102 prevent duty cycles of 100% to 0% and generally can range from 95% to 10%. Thus, adjusting the resistance of variable resistor 106 adjusts the phase angle and, thus, the dimming level represented by the dimmer output voltage $V_{DIM}$. Adjusting the phase angle of dimmer output voltage $V_{DIM}$ modifies the average power to light source 104, which adjusts the intensity of light source 104.

FIG. 1B depicts a lighting circuit 140 with a 3-wire conventional dimmer 150 for dimming incandescent light source 104. The conventional dimmer 150 can be microcontroller based. A pair of the wires carries the AC line voltage $V_{line}$ to light source controller/driver 152. In another embodiment, the line voltage $V_{line}$ is applied directly to the light source controller/driver 152. A third wire carries a dimmer output signal value $D_V$ to light source controller/driver 152. In at least one embodiment, the dimmer 150 is a digital dimmer that receives a dimmer level user input from a user via, for example, push buttons, other switch types, or a remote control, and converts the dimmer level user input into the dimmer output signal value $D_V$. In at least one embodiment, the dimmer output signal value $D_V$ is digital data representing the selected dimming level or other dimmer function. The dimmer output signal value $D_V$ serves as a control signal for light source controller/driver 152. The light source controller/ driver 152 receives the dimmer output signal value $D_V$ and provides a drive current to light source 104 that dims light source 104 to a dimming level indicated by dimmer output signal value $D_V$.

FIG. 2 depicts the duty cycles and corresponding phase angles of the modified dimmer output voltage $V_{DIM}$ waveform of dimmer 102. The dimmer output voltage oscillates during each period from a positive voltage to a negative voltage. (The positive and negative voltages are characterized with respect to a reference direct current (dc) voltage level, such as a neutral or common voltage reference.) The period of each full cycle 202.0 through 202.N is the same frequency as $V_{line}$, where N is an integer. The dimmer 102 chops the voltage half cycles 204.0 through 204.N and 206.0 through 206.N to alter the duty cycle and phase angle of each half cycle. The phase angles are measurements of the points in the cycles of dimmer output voltage $V_{DIM}$ at which chopping occurs. The dimmer 102 chops the positive half cycle 204.0 at time $t_1$ so that half cycle 204.0 is 0 V from time $t_0$ through time $t_1$ and has a positive voltage from time $t_1$ to time $t_2$. The light source 104 is, thus, turned 'off' from times $t_0$ through $t_1$ and turned 'on' from times $t_1$ through $t_2$. Dimmer 102 chops the positive half cycle 206.0 with the same timing as the negative half cycle 204.0. So, the phase angles of each half cycle of cycle 202.0 are the same. Thus, the full phase angle of dimmer 102 is directly related to the duty cycle for cycle 202.0. Equation [1] sets forth the duty cycle for cycle 202.0 is:

$$\text{Duty Cycle} = \frac{(t_2 - t_1)}{(t_2 - t_0)}. \quad [1]$$

When the resistance of variable resistance 106 is increased, the duty cycles and phase angles of dimmer 102 also decreases. Between time $t_2$ and time $t_3$, the resistance of variable resistance 106 is increased, and, thus, dimmer 102 chops the full cycle 202.N at later times in the positive half cycle 204.N and the negative half cycle 206.N of full cycle 202.N with respect to cycle 202.0. Dimmer 102 continues to chop the positive half cycle 204.N with the same timing as the negative half cycle 206.N. So, the duty cycles and phase angles of each half cycle of cycle 202.N are the same.

Since times $(t_5-t_4)<(t_2-t_1)$, less average power is delivered to light source 104 by the sine wave 202.N of dimmer voltage $V_{DIM}$, and the intensity of light source 104 decreases at time $t_3$ relative to the intensity at time $t_2$.

FIG. 3 depicts a measured light versus perceived light graph 300 representing typical percentages of measured light versus perceived light during dimming. The multiple dimming levels of dimmer 102 vary the measured light output of incandescent light source 104 in relation to the resistance of variable resistor 106. Thus, the measured light generated by the light source 104 is a function of the dimmer output voltage $V_{DIM}$. One hundred percent measured light represents the maximum, rated lumen output of the light source 104, and zero percent measured light represents no light output.

A human eye responds to decreases in the measured light percentage by automatically enlarging the pupil to allow more light to enter the eye. Allowing more light to enter the eye results in the perception that the light is actually brighter. Thus, the light perceived by the human is always greater than the measured light. For example, the curve 302 indicates that at 1% measured light, the perceived light is 10%. In one embodiment, measured light and perceived light percentages do not completely converge until measured light is approximately 100%.

Many lighting applications, such as architectural dimming, higher performance dimming, and energy management dimming, involve measured light varying from 1% to 10%. Because of the non-linear relationship between measured light and perceived light, dimmer 102 has very little dimming level range and can be very sensitive at low measured output light levels. Thus, the ability of dimmers to provide precision control at low measured light levels is very limited.

SUMMARY OF THE INVENTION

In one embodiment of the present invention, a method for mapping dimming output signal values of a lighting dimmer using a predetermined lighting output function and driving a light source in response to mapped digital data includes receiving a dimmer output signal and receiving a clock signal having a clock signal frequency. The method also includes detecting duty cycles of the dimmer output signal based on the clock signal frequency and converting the duty cycles of the dimmer output signal into digital data representing the detected duty cycles, wherein the digital data correlates to dimming levels. The method further includes mapping the digital data to light source control signals using the predetermined lighting output function and operating a light source in accordance with the light source control signals.

In another embodiment of the present invention a method for mapping dimming output signal values of a lighting dimmer using a predetermined lighting output function and operating a light source in response to mapped dimming output signal values includes receiving a dimmer output signal, wherein values of the dimmer output signal represent duty cycles having a range of approximately 95% to 10%. The method also includes mapping the dimmer output signal values to light source control signals using the predetermined lighting output function, wherein the predetermined lighting output function maps the dimmer output signal values to the light source control signals to provide an intensity range of the light source of greater than 95% to less than 5%. The method further includes operating a light source in accordance with the light source control signals.

In another embodiment of the present invention, a method for mapping dimming output signal values of a lighting dimmer using a predetermined lighting output function and driving a light source in response to mapped dimmer output signal values includes receiving a dimmer output signal, wherein values of the dimmer output signal represents one of multiple dimming levels. The method also includes applying a signal processing function to alter transition timing from a first light source intensity level to a second light source intensity level and mapping the dimmer output signal values to light source control signals using the predetermined lighting output function. The method further includes operating a light source in accordance with the light source control signals.

In another embodiment of the present invention, a lighting system includes one or more input terminals to receive a dimmer output signal and a duty cycle detector to detect duty cycles of the dimmer output signal generated by a lighting dimmer. The lighting system also includes a duty cycle to time converter to convert the duty cycles of the dimmer output signal into digital data representing the detected duty cycles, wherein the digital data correlates to dimming levels. The lighting system further includes circuitry to map the digital data to light source control signals using a predetermined lighting output function and a light source driver to operate a light source in accordance with the light source control signals.

In a further embodiment of the present invention, a lighting system includes one or more input terminals to receive a dimmer output signal, wherein values of the dimmer output signal represents one of multiple dimming levels. The lighting system also includes a filter to apply a signal processing function to alter transition timing from a first light source intensity level to a second light source intensity level and circuitry to map the dimmer output signal values to light source control signals using the predetermined lighting output function. The lighting system also includes a light source driver to operate a light source in accordance with signals derived from the light source control signals.

In another embodiment of the present invention, a lighting system for mapping dimming output signal values of a lighting dimmer using a predetermined lighting output function and operating a light source in response to mapped dimming output signal values includes one or more input terminals to receive a dimmer output signal, wherein values of the dimmer output signal represent duty cycles having a range of approximately 95% to 10%. The lighting system also includes circuitry to map the dimmer output signal values to light source control signals using the predetermined lighting output function, wherein the predetermined lighting output function maps the dimmer output signal values to the light source control signals to provide an intensity range of the light source of greater than 95% to less than 5%. The lighting system also includes a light source driver to operate a light source in accordance with the light source control signals.

BRIEF DESCRIPTION OF THE DRAWINGS

The present invention may be better understood, and its numerous objects, features and advantages made apparent to those skilled in the art by referencing the accompanying drawings. The use of the same reference number throughout the several figures designates a like or similar element.

DETAILED DESCRIPTION

A system and method map dimming levels of a lighting dimmer to light source control signals using a predetermined lighting output function. In at least one embodiment, the dimmer generates a dimmer output signal value. At any particular period of time, the dimmer output signal value represents one of multiple dimming levels. In at least one embodiment, the lighting output function maps the dimmer output signal values to any lighting output function such as a light level function, a timing function, or any other light source control function. In at least one embodiment, the lighting output function maps the dimmer output signal value to one or more different dimming values that is/are different than the dimming level represented by the dimmer output signal value. In at least one embodiment, the lighting output function converts a dimmer output signal values corresponding to measured light levels to perception based light levels. A light source driver operates a light source in accordance with the predetermined lighting output function. In at least one embodiment, the system and method includes a filter to apply a signal processing function to alter transition timing from a first light source intensity level to a second light source intensity level.

Figure 4A:
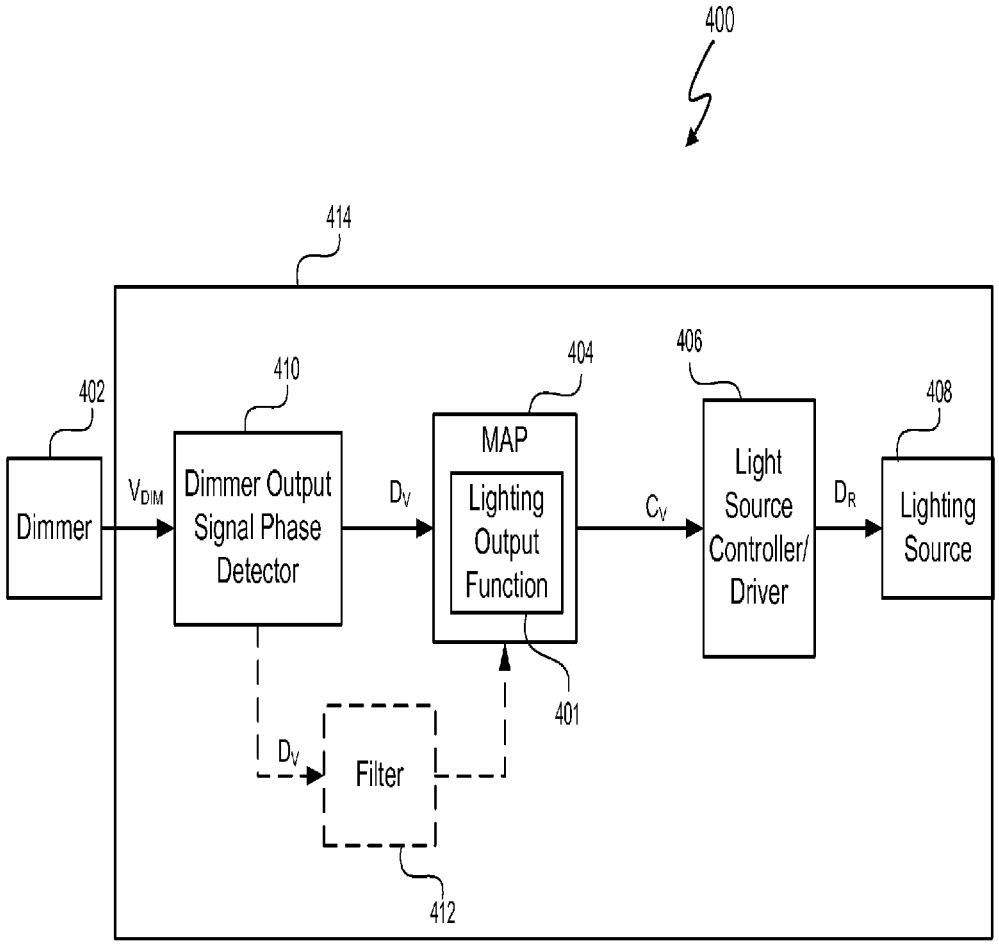
FIG. 4A depicts a lighting system that maps dimming levels of a lighting dimmer to light source control signals in accordance with a predetermined lighting output function.

FIG. 4A depicts a lighting system 400 that maps dimming levels of a lighting dimmer 402 to light source control signals in accordance with a predetermined lighting output function 401. In at least one embodiment, dimmer 402 is a conventional dimmer, such as dimmer 102 or dimmer 150. Dimmer 402 provides a dimmer output signal $V_{DIM}$. During a period of time, the dimmer output signal $V_{DIM}$ has a particular value $D_V$. For example, the dimmer output signal value $D_V$ is the phase angle of dimmer output signal $V_{DIM}$. The dimmer output signal value $D_V$ represents a dimming level. Without the map, the light source controller/driver 406 would map the dimmer output signal value $D_V$ to a dimming level corresponding to a measured light percentage. U.S. Provisional Application entitled "Ballast for Light Emitting Diode Light Sources" describes an exemplary light source controller/driver 406.

Figure 1A:
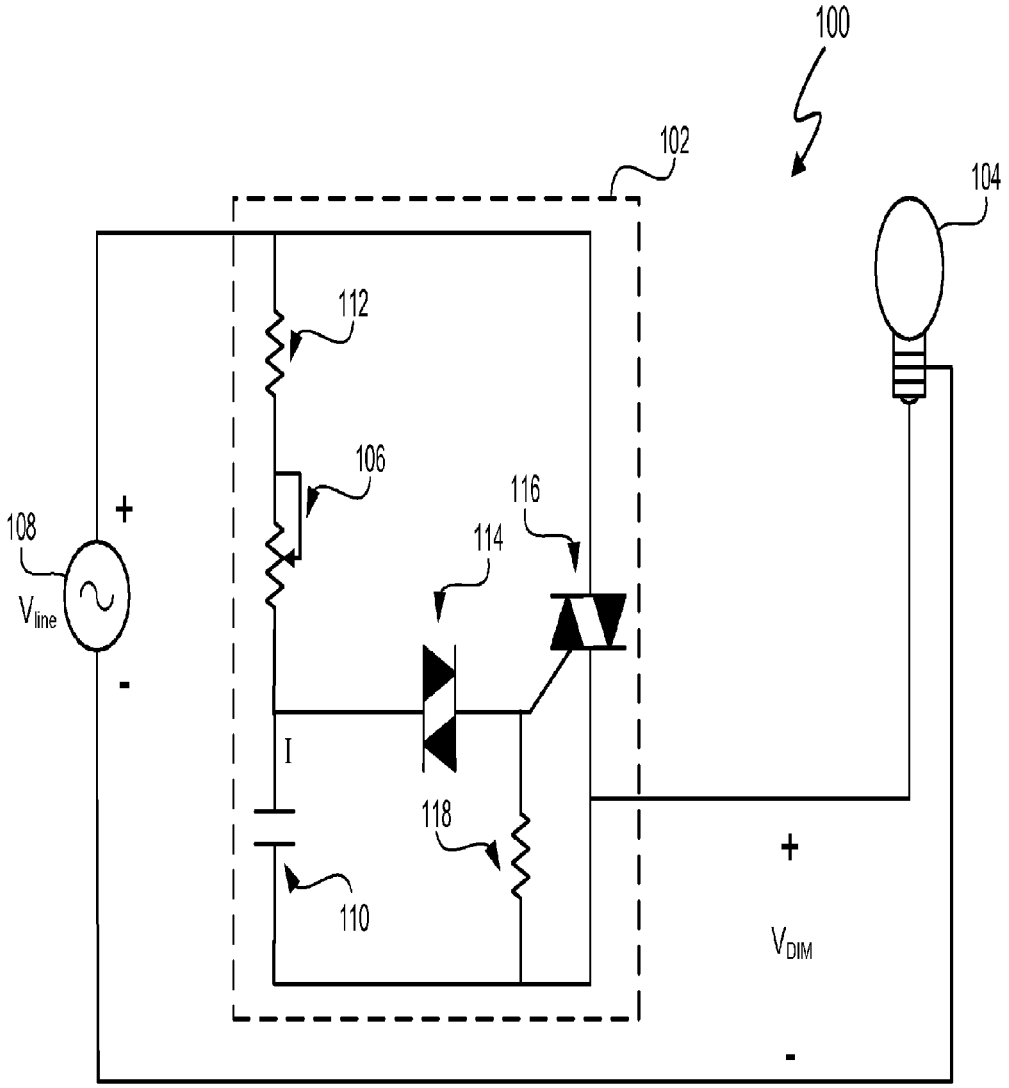
Figure 1A (prior art)
FIG. 1A (labeled prior art) depicts a lighting circuit with a conventional dimmer for dimming incandescent lamp.
Figure 1B:
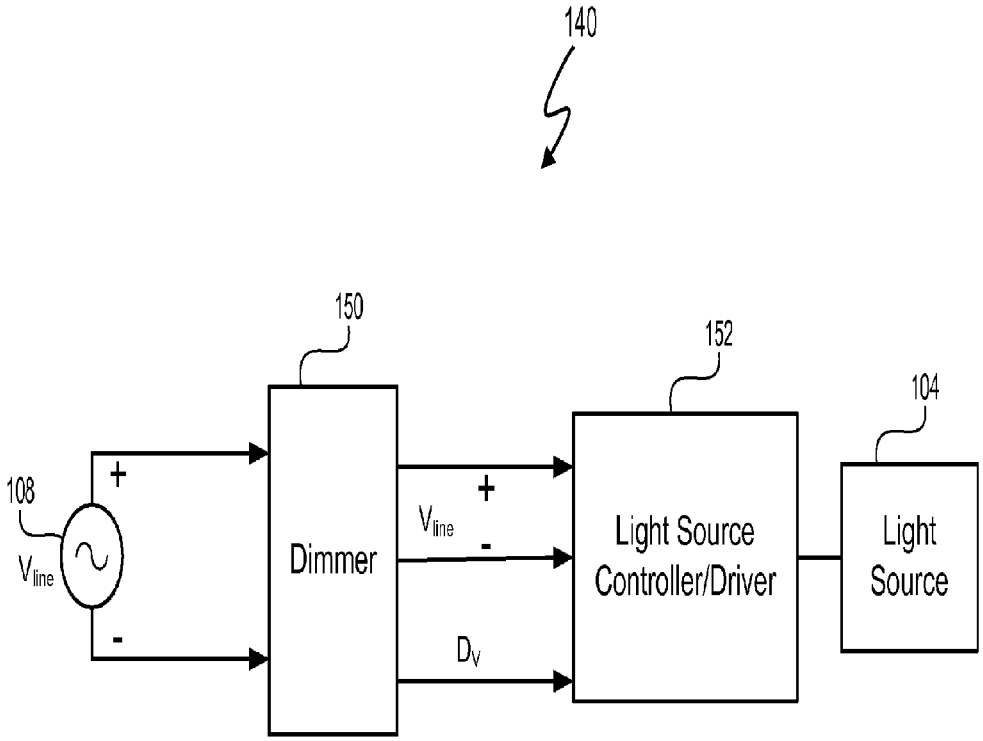
Figure 1B (prior art)
FIG. 1B (labeled prior art) depicts a lighting circuit with a conventional dimmer for dimming incandescent lamp.
Figure 2:
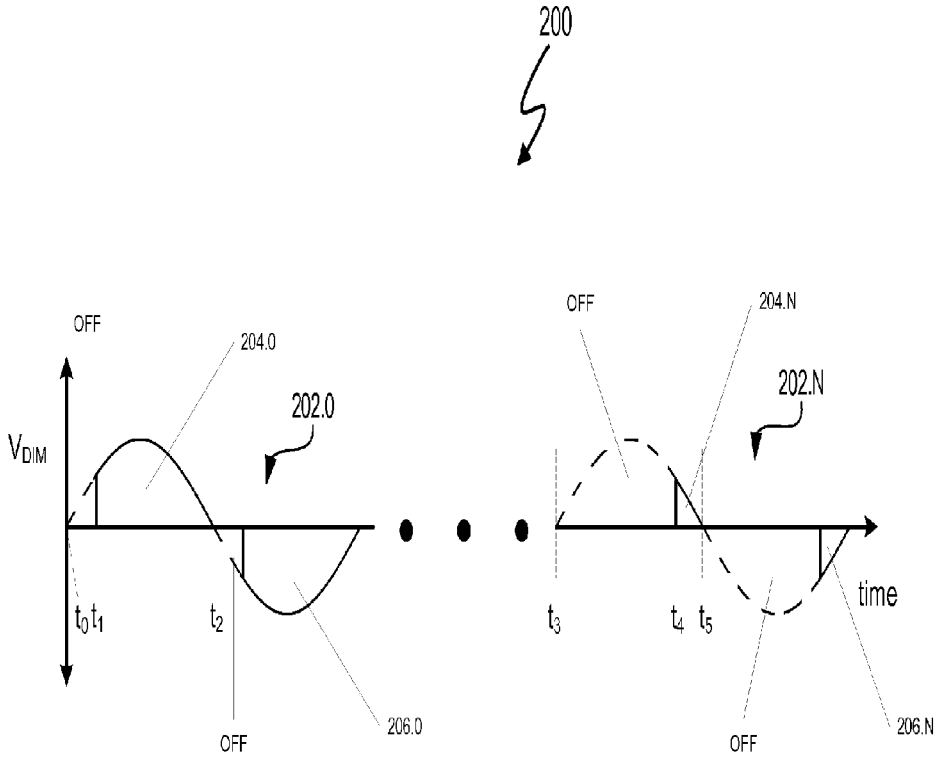
Figure 2 (prior art)
FIG. 2 (labeled prior art) depicts a phase angle modified dimmer output voltage waveform of a dimmer.

In at least one embodiment, a user selects a dimmer output signal value $D_V$ using a control (not shown), such as a slider, push button, or remote control, to select the dimming level. In at least one embodiment, the dimmer output signal $V_{DIM}$ is a periodic AC voltage. In at least one embodiment, in response to a dimming level selection, dimmer 402 chops the line voltage $V_{line}$ (FIG. 1) to modify a phase angle of the dimmer output signal $V_{DIM}$. The phase angle of the dimmer output signal $V_{DIM}$ corresponds to the selected dimming level. The dimmer output signal phase detector 410 detects the phase angle of dimmer output signal $V_{DIM}$. The dimmer output signal detector 410 generates a dimmer output signal value $D_V$ that corresponds to the dimming level represented by the phase angle of dimmer output signal $V_{DIM}$. In at least one embodiment, the dimmer output signal phase detector 410 includes a timer circuit that uses a clock signal $f_{clk}$ having a known frequency, and a comparator to compare the dimmer output signal $V_{DIM}$ to a neutral reference. Increasing the clock frequency increases the accuracy of phase detector 410. The dimmer output signal $V_{DIM}$ has a known frequency. The dimmer output signal phase detector 410 determines the phase angle of dimmer output signal $V_{DIM}$ by counting the number of cycles of clock signal $f_{clk}$ that occur until the chopping point (i.e. an edge of dimmer output signal $V_{DIM}$) of dimmer output signal $V_{DIM}$ is detected by the comparator.

Figure 4B:
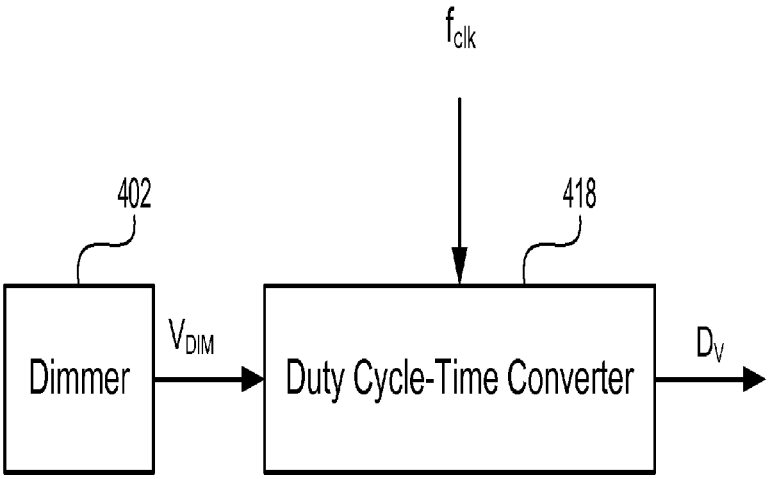
FIG. 4B depicts a duty cycle time converter that converts the dimmer input signal into digital data.

FIG. 4B depicts a duty cycle time converter 418 that converts the dimmer input signal $V_{DIM}$ into a digital dimmer output signal value $D_V$. The duty cycle time converter 418 is a substitution for dimmer output signal phase detector 410 in lighting system 400. The digital data of dimmer output signal value $D_V$ represents the duty cycles of dimmer output voltage $V_{DIM}$. The duty cycle time converter 418 determines the duty cycle of dimmer output signal $V_{DIM}$ by counting the number of cycles of clock signal $f_{clk}$ that occur until the chopping point of dimmer output signal $V_{DIM}$ is detected by the duty cycle time converter 418.

Figure 4C:
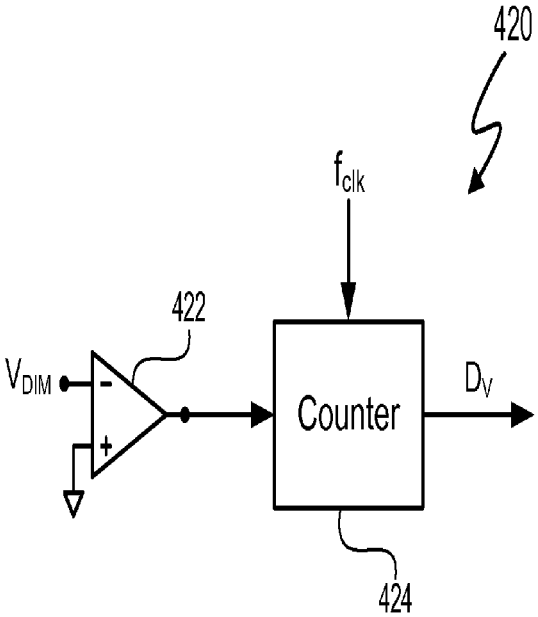
FIG. 4C depicts a duty cycle time converter.

FIG. 4C depicts a duty cycle time converter 420 that represents one embodiment of duty cycle time converter 418. Comparator 422 compares dimmer output voltage $V_{DIM}$ against a known reference. The reference is generally the cycle cross-over point voltage of dimmer output voltage $V_{DIM}$, such as a neutral potential of a household AC voltage. The counter 424 counts the number of cycles of clock signal $f_{clk}$ that occur until the comparator 422 indicates that the chopping point of dimmer output signal $V_{DIM}$ has been reached. Since the frequency of dimmer output signal $V_{DIM}$ and the frequency of clock signal $f_{clk}$ is known, the duty cycle can be determined from the count of cycles of clock signal $f_{clk}$ that occur until the comparator 422 indicates that the chopping point of dimmer output signal $V_{DIM}$. Likewise, the phase angle can also be determined by knowing the elapsed time from the beginning of a cycle of dimmer output signal $V_{DIM}$ until a chopping point of dimmer output signal $V_{DIM}$ is detected.

Figure 4D:
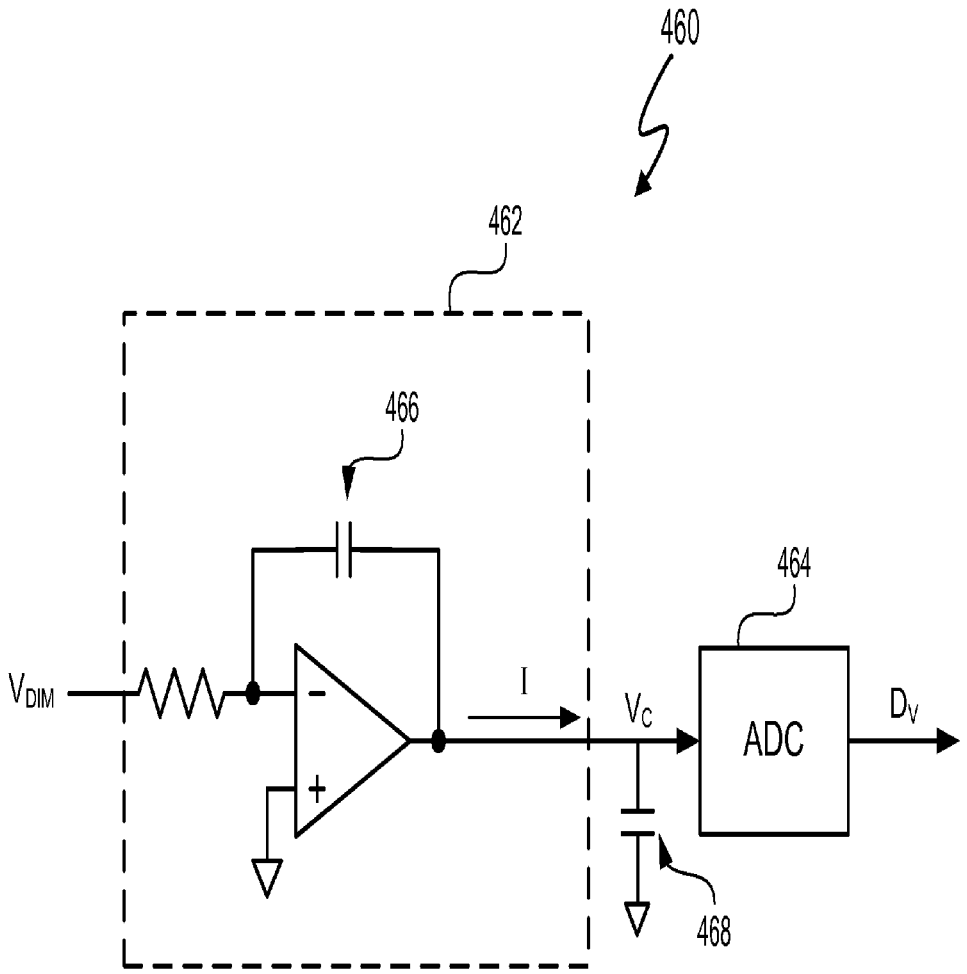
FIG. 4D depicts a duty cycle detector.

FIG. 4D depicts a duty cycle detector 460. The duty cycle detector 460 includes an analog integrator 462 that integrates dimmer output signal $V_{DIM}$ during each cycle (full or half cycle) of dimmer output signal $V_{DIM}$. The analog integrator 462 generates a current I corresponding to the duty cycle of dimmer output signal $V_{DIM}$ for each cycle of dimmer output signal $V_{DIM}$. The current provided by the analog integrator 462 charges a capacitor 468, and the voltage $V_C$ of the capacitor 468 can be determined by analog-to-digital converter (ADC) 464. The voltage $V_C$ directly corresponds to the duty cycle of dimmer output signal $V_{DIM}$. The analog integrator 462 can be reset after each cycle of dimmer output signal $V_{DIM}$ by discharging capacitors 462 and 468. The output of analog-to-digital converter 424 is digital data representing the duty cycle of dimmer output signal $V_{DIM}$.

In another embodiment, dimmer output signal $V_{DIM}$ can be chopped to generated both leading and trailing edges of dimmer voltage $V_{DIM}$. U.S. Pat. No. 6,713,974, entitled "Lamp Transformer For Use With An Electronic Dimmer And Method For Use Thereof For Reducing Acoustic Noise", inventors Patchornik and Barak, describes an exemplary system and method for leading and trailing edge dimmer voltage $V_{DIM}$ chopping and edge detection. U.S. Pat. No. 6,713,974 is incorporated herein by reference in its entirety.

In at least one embodiment, the mapping circuitry 404 receives the dimmer output signal value $D_V$. The mapping circuitry 404 includes lighting output function 401. The lighting output function 401 maps the dimmer output signal value $D_V$ to a control signal $C_V$. The light source controller/driver 406 generates a drive signal $D_R$ in response to the control signal $C_V$. In at least one embodiment, the control signal $C_V$ maps the dimmer output signal value to a different dimming level than the dimming level represented by the dimmer output signal value $D_V$. For example, in at least one embodiment, the control signal $C_V$ maps the dimmer output signal value $D_V$ to a human perceived lighting output levels in, for example, with an approximately linear relationship. The lighting output function 401 can also map the dimmer output signal value $D_V$ to other lighting functions. For example, the lighting output function 401 can map a particular dimmer output signal value $D_V$ to a timing signal that turns the lighting source 408 "off" after a predetermined amount of time if the dimmer output signal value $D_V$ does not change during the predetermined amount of time.

The lighting output function 401 can map dimming levels represented by values of a dimmer output signal to a virtually unlimited number of functions. For example, lighting output function 401 can map a low percentage dimming level, e.g. 90% dimming) to a light source flickering function that causes the light source 408 to randomly vary in intensity for a predetermined dimming range input. In at least one embodiment, the intensity of the light source results in a color temperature of no more than 2500 K. The light source controller/driver 406 can cause the lighting source 408 to flicker by providing random power oscillations to lighting source 408.

In one embodiment, values of the dimmer output signal dimmer output signal $V_{DIM}$ represent duty cycles having a range of approximately 95% to 10%. The lighting output function 402 maps dimmer output signal values to light source control signals using the lighting output function 401. The lighting output function maps the dimmer output signal values to the light source control signals to provide an intensity range of the light source 408 of greater than 95% to less than 5%.

The implementation of mapping circuitry 404 and the lighting output function 401 are a matter of design choice. For example, the lighting output function 401 can be predetermined and embodied in a memory. The memory can store the lighting output function 401 in a lookup table. For each dimmer output signal value $D_V$, the lookup table can include one or more corresponding control signal values $C_V$. Multiple control signal values $C_V$ can be used to generate multiple light source control signals $D_R$. When multiple mapping values are present, control signal $C_V$ is a vector of multiple mapping values. In at least one embodiment, the lighting output function 401 is implemented as an analog function generator that correlates dimmer output signal values with mapping values.

Figure 3:
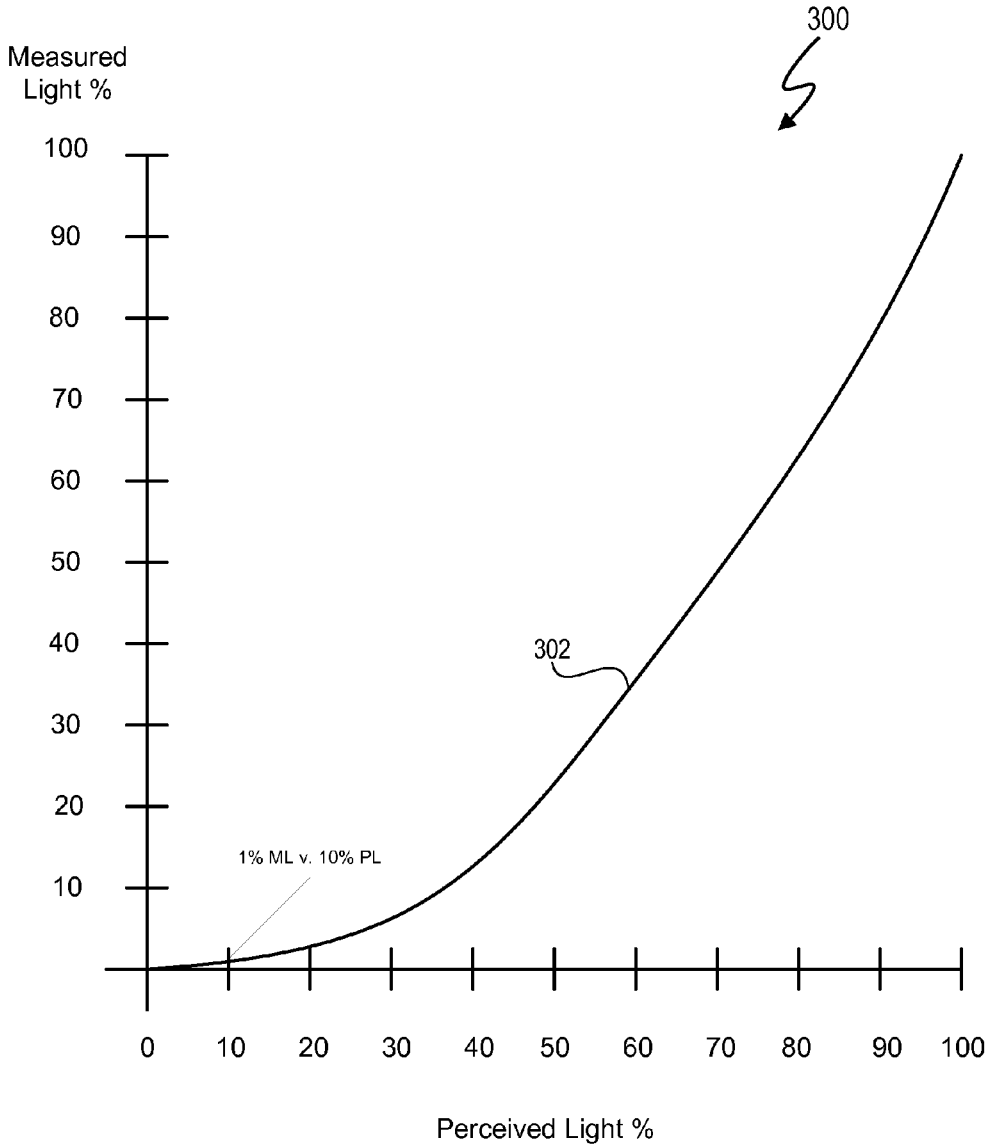
Figure 3 (prior art)
FIG. 3 (labeled prior art) depicts a measured light versus perceived light graph during dimming.
Figure 5:
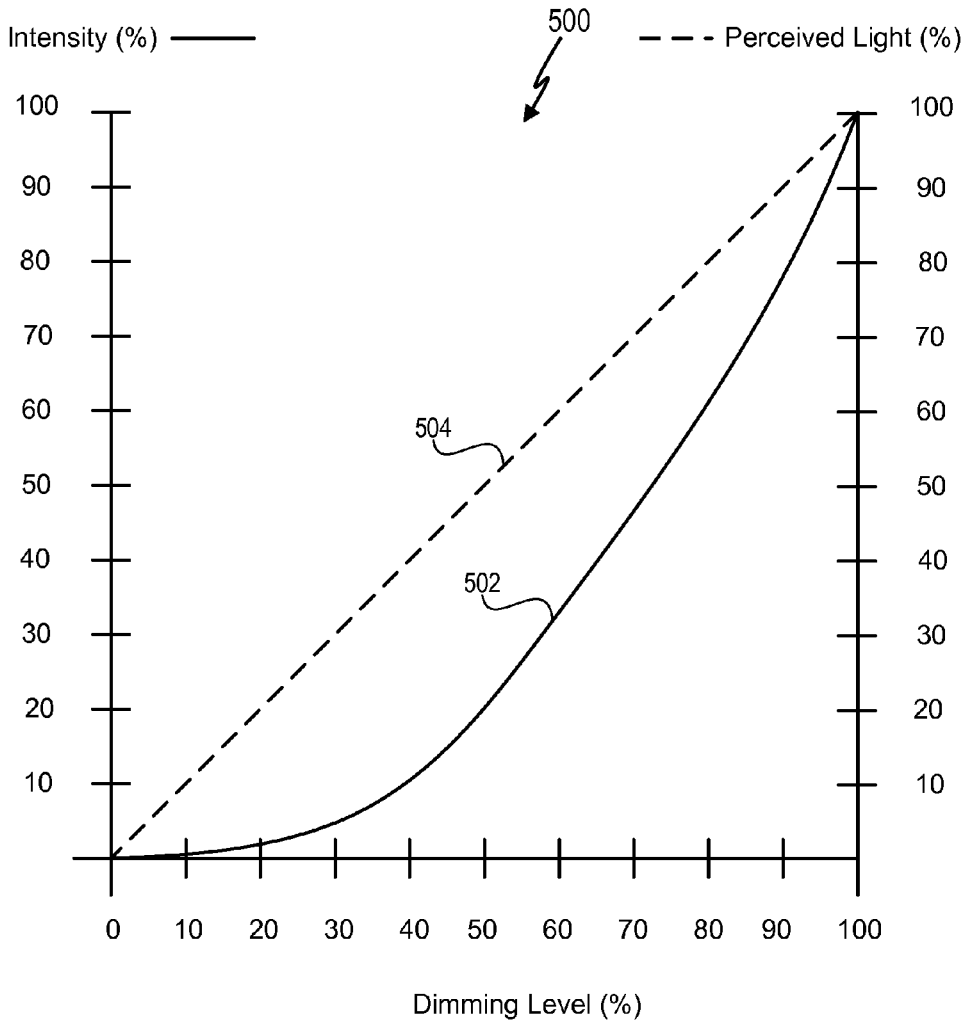
FIG. 5 depicts a graphical depiction of an exemplary lighting output function.

FIG. 5 depicts a graphical depiction 500 of an exemplary lighting output function 401. Referring back to the perceived light graph 300 (FIG. 3), conventionally as measured light percentage changed from 10% to 0%, the perceived light changed from about 32% to 0%. The exemplary lighting output function 401 maps the intensity percentage as indicated by the dimmer output signal value $D_V$ to a value that provides a linear, one-to-one relationship between perceived light percentages and dimming level percentages. Thus, when the dimming level is set to 50%, the perceived light percentage is also 50%, and so on. By providing a one-to-one linear relationship, the exemplary lighting output function 401 provides the dimmer 402 with greater sensitivity at high dimming level percentages.

In another embodiment, the lighting output function 401 includes a flickering function that maps a dimmer output signal value $D_V$ corresponding to a low light intensity, such as a 10% duty cycle, to control signals that cause lighting source 408 to flicker at a color temperature of no more than 2500 K. In at least one embodiment, flickering can be obtained by providing random power oscillations to lighting source 408.

The light source controller/driver 406 receives each control signal $C_V$ and converts the control signal $C_V$ into a control signal for each individual light source or each group of individual light sources in lighting source 408. The light source controller/driver 406 provides the raw DC voltage to lighting source 408 and controls the drive current(s) in lighting source 408. The control signals $D_R$ can, for example, provide pulse width modulation control signals to switches within lighting source 408. Filter components within lighting source 408 can filter the pulse width modulated control signals $D_R$ to provide a regulated drive current to each light source in lighting source 408. The value of the drive currents is controlled by the control signals $D_R$, and the control signals $D_R$ are determined by the mapping values from mapping circuitry 404.

A signal processing function can be applied in lighting system 400 to alter transition timing from a first light source intensity level to a second light source intensity level. The function can be applied before or after mapping with the lighting output function 401. In at least one embodiment, the signal processing function is embodied in a filter. In at least one embodiment, lighting system 400 includes a filter 412. When using filter 412, filter 412 processes the dimmer output signal value $D_V$ prior to passing the filtered dimmer output signal value $D_V$ to mapping circuitry 404. The dimmer output voltage $V_{DIM}$ can change abruptly, for example, when a switch on dimmer 402 is quickly transitioned from 90% dimming level to 0% dimming level. Additionally, the dimmer output voltage can contain unwanted perturbations caused by, for example, fluctuations in line voltage that supplies power to lighting system 400 through dimmer 402. Filter 412 can represent any function that changes the dimming levels indicated by the dimmer output signal value $D_V$. Filter 412 can be implemented with analog or digital components. In another embodiment, the filter filters the control signals $D_R$ to obtain the same results.

Figure 6:
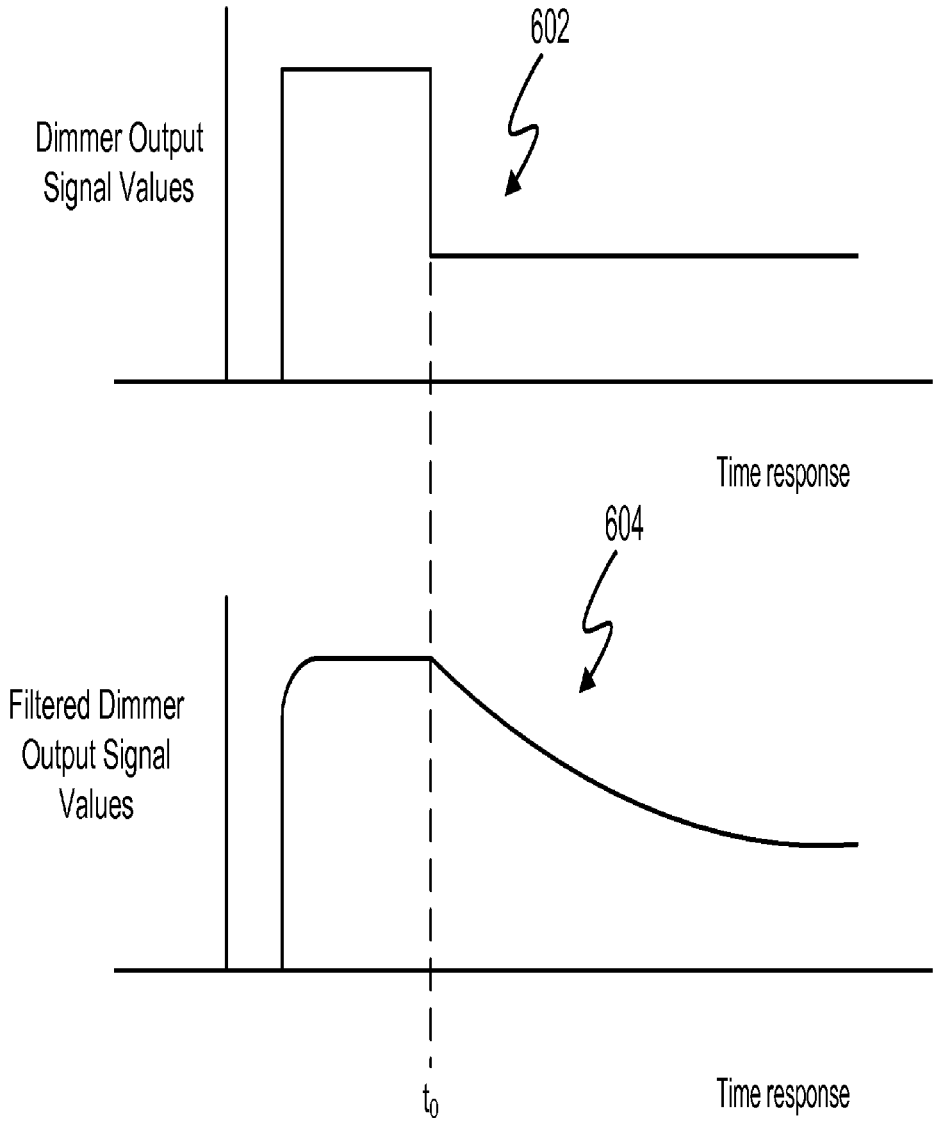
FIGS. 6 and 7 depict exemplary dimmer output signal values and filtered dimmer output signal values correlated in the time domain.

FIG. 6 depicts exemplary dimmer output signal values 602 and filtered dimmer output signal values 604 correlated in the time domain. The dimmer output signal values 602 abruptly change at time $t_0$. The filter 412 filters the dimmer output signal values 604 with a low pass averaging function to obtain a smooth dimming transition as indicated by the filtered dimmer output signal values 604. In at least one embodiment, abrupt changes from high dimming levels to low dimming levels are desirable. The filter 412 can also be configured to smoothly transition low to high dimming levels while allowing an abrupt or much faster transition from high to low dimming levels.

Figure 7:
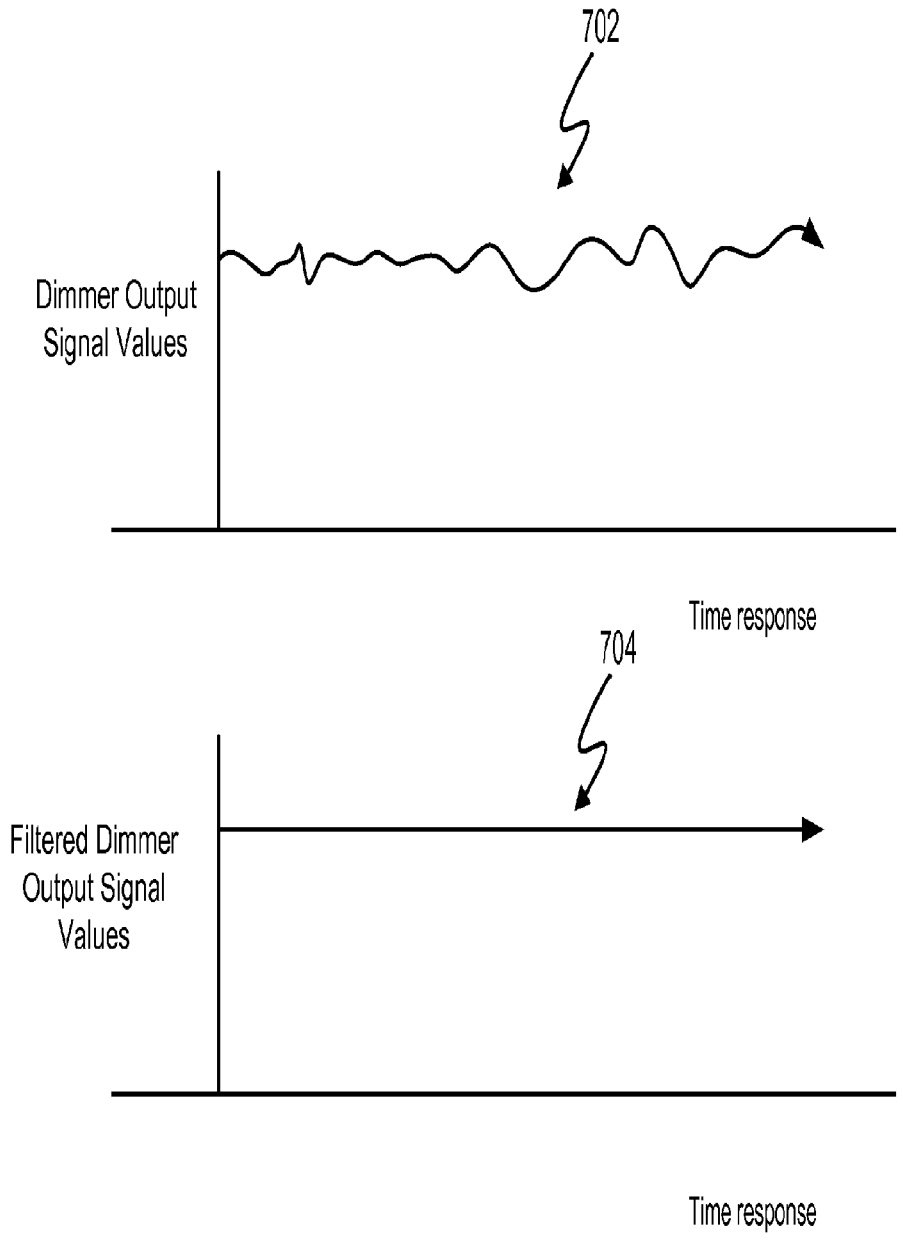

FIG. 7 depicts exemplary dimmer output signal values 702 and filtered dimmer output signal values 704 correlated in the time domain. The dimmer output signal values 702 contain perturbations (ripples) over time. The perturbations can be caused, for example, by fluctuations in line voltage. The filter 412 can use a low pass filter transfer function to smooth perturbations in the dimmer output signal values 702.

Lighting source 408 can include a single light source or a set of light sources. For example, lighting source 408 can include one more light emitting diodes or one or more gas discharge lamps. Each lighting source 408 can be controlled individually, collectively, or in groups in accordance with the control signal $C_V$ generated by mapping circuitry 404. The mapping circuitry 404, light source controller/driver 406, lighting source 408, dimmer output signal phase detector 410, and optional filter 412 can be collectively referred to as a lighting device. The lighting device 414 can include a housing to enclose mapping circuitry 404, light source controller/driver 406, lighting source 408, dimmer output signal phase detector 410, and optional filter 412. The housing can include terminals to connect to dimmer 402 and receive power from an alternating current (AC) voltage source. The components of lighting device 414 can also be packaged individually or in groups. In at least one embodiment, the mapping circuitry 404, light source controller/driver 406, dimmer output signal phase detector 410, and optional filter 412 are integrated in a single integrated circuit device. In another embodiment, integrated circuits and/or discrete components are used to build the mapping circuitry 404, light source controller/driver 406, dimmer output signal phase detector 410, and optional filter 412.

Although the present invention has been described in detail, it should be understood that various changes, substitutions and alterations can be made hereto without departing from the spirit and scope of the invention as defined by the appended claims.

What is claimed is:

1. A method for mapping dimming output signal values of a lighting dimmer using a predetermined lighting output function and driving a light source in response to mapped digital data, the method comprising:

receiving a dimmer output signal;

detecting duty cycles of the dimmer output signal;

converting the duty cycles of the dimmer output signal into digital data representing the detected duty cycles, wherein the digital data correlates to dimming levels;

mapping the digital data to light source control signals using the predetermined lighting output function; and generating the light source control signals to control operation of the light source.

2. The method of claim 1 further comprising:

receiving alternating current (AC) power from a voltage source on a pair of input terminals; and receiving the dimmer output signal further comprises receiving the dimmer output signal using at least one of the input terminals.

3. The method of claim 1 wherein mapping the digital data to light source control signals using the predetermined lighting output function further comprises:

mapping the digital data to a dimming level different than the dimming level represented by the dimmer output signal value.

4. The method of claim 1 wherein:

mapping the digital data to light source control signals using the predetermined lighting output function further comprises:

mapping the digital data to a light source flickering function that causes the light source to randomly vary in intensity for a predetermined dimming range of input dimming levels.

5. The method of claim 1 wherein mapping the digital data to light source control signals using the predetermined lighting output function further comprises:

retrieving the predetermined lighting output function from a memory, wherein data in the memory associates the retrieved predetermined lighting output function with the dimming level represented by the dimmer output signal value.

6. The method of claim 1 wherein the predetermined lighting output function maps dimmer output levels to human perceived lighting output levels with an approximately linear relationship.

7. The method of claim 1 further comprising:

low pass filtering at least a set of values of the digital data representing dimming levels below a predetermined threshold level to decrease a rate of change in the perceived light of the light source indicated by the dimmer output signal duty cycles.

8. The method of claim 1 wherein the light source includes one or more lighting elements selected from the group consisting of: one or more light emitting diodes, one or more gas discharge lamps, and one or more incandescent lamps.

9. The method of claim 1 further comprising:

receiving a clock signal having a clock signal frequency; and wherein detecting duty cycles of the dimmer output signal further comprises detecting duty cycles of the dimmer output signal based on the clock signal frequency.

10. The method of claim 1 wherein:

values of the dimmer output signal represent duty cycles of the dimmer output signal having a range of within approximately 95% to 10% of a full duty cycle that without mapping indicate a first intensity range of light output from the light source; and mapping the digital data to light source control signals using the predetermined lighting output function comprises mapping the digital data to light source control signals using the predetermined lighting output function to map the dimmer output signal values to the light source control signals to provide an expanded intensity range of light output from the light source to at least less than 5% of a full intensity range of light output from the light source.

11. A lighting system comprising:

a controller, the controller comprising:

a duty cycle detector to detect duty cycles of a dimmer output signal generated by a lighting dimmer;

a converter to convert the duty cycles of the dimmer output signal into digital data representing the detected duty cycles, wherein the digital data correlates to dimming levels;

circuitry to map the digital data to light source control signals using a predetermined lighting output function; and a control signal generator to generate light source control signals to control operation of a light source.

12. The lighting system of claim 11 wherein the circuitry is configured to map the digital data to a dimming different level than the dimming level represented by the duty cycle of the dimmer output signal.

13. The lighting system of claim 11 wherein the circuitry is configured to map the digital data to the control signals using a light source flickering function that causes the light source to randomly vary in intensity for a predetermined dimming range of input dimming levels.

14. The lighting system of claim 11 wherein the circuitry to map the dimmer output signal value comprises a memory having data associating the retrieved predetermined lighting output function with the dimming level represented by the duty cycles of the dimmer output signal.

15. The lighting system of claim 11 wherein the lighting output function linearly maps duty cycles of the digital output signal to human perceived lighting output levels.

16. The lighting system of claim 11 further comprising:

a filter to filter at least a set value of the digital data prior to mapping the dimmer output signal values, wherein the filter has a transfer function to low pass filter values of the digital data representing dimming levels below a predetermined threshold level to decrease a rate of change in the perceived light of the light source indicated by the duty cycles of the dimmer output signal.

17. The lighting system of claim 11 wherein the light source includes one or more lighting elements selected from the group consisting of: one or more light emitting diodes, one or more gas discharge lamps, and one or more incandescent lamps.

18. The lighting system of claim 11 further comprising:

the light source; and a switching power converter, coupled to the controller and the light source, wherein the switching power converter includes a switch having a control terminal to receive the light source control signals and the switch is configured to operate the light source in accordance with the light source control signals.

19. The lighting system of claim 11:

wherein the controller is further configured to receive a clock signal having a clock signal frequency; and the duty cycle detector is further configured to detect duty cycles of the dimmer output signal based on the clock signal frequency.

20. The lighting system of claim 11 wherein:

values of the dimmer output signal represent duty cycles of the dimmer output signal having a range of within approximately 95% to 10% of a full duty cycle that without mapping indicate a first intensity range of light output from the light source; and circuitry to map the digital data to light source control signals using a predetermined lighting output function comprises circuitry to map the digital data to light source control signals using the predetermined lighting output function to map the dimmer output signal values to the light source control signals to provide an expanded intensity range of light output from the light source to at least less than 5% of a full intensity range of light output from the light source.

* * * * *